United States Patent [19]

Gamauf

[11] Patent Number: 4,761,987

[45] Date of Patent: Aug. 9, 1988

[54] DOOR LOCK OPENING RESTORING TOOL AND METHOD FOR USING THE SAME

[76] Inventor: Richard J. Gamauf, 7260 W. 112th St., Worth, Ill. 60482

[21] Appl. No.: 26,015

[22] Filed: Mar. 16, 1987

[51] Int. Cl.[4] ..... B21D 1/12

[52] U.S. Cl. ..... 72/414; 72/454; 72/705

[58] Field of Search ..... 29/266, 402.19; 72/390, 72/414, 415, 454, 474, 705

[56] References Cited

U.S. PATENT DOCUMENTS

| | | | |
|---|---|---|---|
| 2,413,518 | 12/1946 | Rechton et al. | 72/414 |
| 4,445,264 | 5/1984 | Banerian | 72/454 |
| 4,495,687 | 1/1985 | Sieveking | 72/454 |

*Primary Examiner*—Lowell A. Larson
*Attorney, Agent, or Firm*—Frank J. Uxa

[57] ABSTRACT

A tool useful for restoring a damaged door lock opening associated with a transportation vehicle comprises: a first die having a hole located therethrough and an outwardly extending projection; a second die having a hole located therethrough and an inwardly extending indent sized to be capable of receiving at least a portion of the projection, provided that at least one of the above-noted holes is threaded; and a threaded bolt adapted and sized to be capable of passing into at least a portion of both of the holes simultaneously, the bolt including threads which are engagable with the threads in the hole or holes as the bolt passes into the holes.

16 Claims, 1 Drawing Sheet

DOOR LOCK OPENING RESTORING TOOL AND METHOD FOR USING THE SAME

FIELD OF THE INVENTION

The present invention relates to a tool for restoring door lock openings and to a method for restoring such openings using such tool. More particularly, the invention relates to a tool and method for restoring damaged door lock openings associated with transportation vehicles.

BACKGROUND OF THE INVENTION

Door lock openings associated with transportation vehicles, e.g., automobiles, trucks, vans and the like, very often include a recess or offset in the body work of the vehicle so that the lock itself, when it is in place, is substantially flush with the exterior of the vehicle body.

Vehicle theft is quite common. One way of breaking into the vehicle is to remove the door lock. In the process of removing the lock, the door lock opening is usually damaged. When the vehicle is recovered, this damage must be repaired for appearance sake and so that the door lock may be made operable. For example, one repair approach involves replacing all or a portion of the damaged door panel with a new undamaged panel. Also, the damage can be repaired by pounding the door lock opening back into shape using a hammer or similar device. In situations where the door opening is substantially flush with the exterior of the vehicle, the damaged opening has been "squeezed" back into shape between two flat washers using a nut and bolt assembly. It would be advantageous to provide a new approach to repairing damaged vehicle door lock openings, particularly such openings which are recessed relative to the exterior of the vehicle.

In preparing this application, the following U.S. Pat. Nos. were considered: 1,367,818; 1,420,064; 1,911,614; 2,509,330; 2,791,186; 4,235,090; and 4,495,687.

SUMMARY OF THE INVENTION

Therefore, one object of the present invention is to provide a tool useful for restoring a damaged door lock opening associated with a transportation vehicle.

Another object of the invention is to provide a method for restoring a damaged door lock opening associated with a transportation vehicle. Other objects and advantages of the present invention will become apparent hereinafter.

In one broad aspect, the present tool comprises a first and second die, structured as defined herein, and a bolt. The first die or die means has a hole located therethrough and an outwardly extending projection. The second die or die means also has a hole located therethrough and, in addition, has an inwardly extending indent sized to be capable of receiving at least a portion, preferably substantially all, of the first die's projection. At least one, and preferably only one, of the above-noted holes is threaded. Preferably the hole through the second die means is threaded. The bolt or bolt means is adapted and sized to be capable of passing into at least a portion of both of the above-noted holes simultaneously. The bolt means includes threads which are engagable with the threads in the hole or holes as the bolt means passes, or is passed, into the holes.

This tool can be used to restore the damaged door lock opening using a method which comprises placing the two die means on either side of the damaged door lock opening so that the projection contacts at least a portion of the damaged opening and the indent faces the projection. The threaded bolt means is passed into the holes in the two die means so that the space between the first and second die means is reduced. By reducing this space, the damaged door lock means is restored, preferably to substantially its original shape. This system is particularly useful where the door lock opening is recessed relative to the exterior of the vehicle.

The present tool and method provides substantial advantages. For example, the tool is relatively inexpensive and easy to manufacture and use. Vehicle door lock openings can be speedily repaired, thus making this job, which has often been relatively labor intensive in the past, less costly overall. In short, the present system represents a significant improvement in the repair of vehicle door lock openings.

The damaged door lock openings which can be repaired in accordance with the present invention are associated with transportation vehicles, as discussed above. This opening can be in any door on the vehicle, e.g., front door, middle door, back door, tail gate, trunk door and the like. As noted above, the present invention is particularly applicable in situations where the door lock opening is recessed relative to the exterior of the vehicle, e.g., relative to the exterior surface of the door panel adjacent to the door lock opening. As used herein, the term "door lock opening" refers not only to the opening itself into which the door lock is to be placed, but also to that portion of the vehicle's door panel immediately adjacent to such opening.

The first and second dies can be constructed from any suitable material. Preferably, the dies are constructed from the same material. The dies and bolt are preferably constructed of metal. In one embodiment, the two dies are harder, i.e., more durable, than the bolt. This feature serves as a degree of protection for the dies, which are often precisely machined and are, therefore, more expensive than the bolt. Thus, if the force attempting to bring the two dies together, i.e., to reduce the space between the two dies, is too great (beyond a safe and/or predetermined limit), the bolt will break before any substantial damage is done to the dies. The broken bolt can be easily replaced and the tool can continue to be used. In one particular embodiment, the dies are machined out of steel and then the machined dies are heat treated, e.g., carburized to a hardness of about 55 to 56 Rc, while the bolt is constructed of carbon steel with no treatment to increase its hardness.

The first die means preferably includes a front face and a rear face which includes the projection. The second die means preferably includes a front face including the indent and a rear face. More preferably, both the front face of the first die means and the rear face of the second die means are substantially flat. If the door lock opening is not recessed relative to the exterior of the vehicle, the tool can be used by placing the two dies on either side of the door lock opening so that the substantially flat faces face each other. The bolt is then passed in the holes as described herein. This preferred feature, i.e., substantially flat die faces, adds to the flexibility of the present system.

The second die means, which is preferably placed adjacent to the interior surface of the door panel, is preferably shaped to avoid interfering with other components of the door, e.g., the door panel. For example, the door panel may include another recessed area designed to accommodate the door handle. This handle recessed area is often very closed to the door lock opening. In this case, the second die is preferably shaped to avoid damaging this handle recess area of the door panel. In one specific embodiment, the front face of the second die means is truncated to avoid interfering with other components of the door, e.g., the recessed handle area of the door panel.

Preferably, each of the first and second die means is generally circular in cross-section along the longitudinal axis of the through hole. Also, the holes are preferably centrally located through the first and second die means, respectively. Each of the projection and indent is preferably generally circular in cross sections along the longitudinal axis of the hole through the first die means and the second die means respectively. Each of these through holes in the first die means and the second die means is substantially centrally located relative to the projection and the indent, respectively.

In one embodiment, the present tool further comprises a washer or a washer means adapted and sized to be placed on the bolt. This washer acts to distribute the force involved in passing the bolt into the holes of the first and second dies. In other words, the washer acts to distribute the force involved in moving the bolt through the die holes so that the door lock opening between the two dies is more effectively restored.

Once the present tool has been used to at least partially restore the shape of the door lock opening, other finishing techniques may be employed to complete the reconstruction of the opening. For example, in many instances during a vehicle theft, the door lock opening is ripped, or torn, or cracked open. After the present tool is used, this rip, tear or crack must be repaired. This can be done by welding the rip, tear or crack, or by using conventional automotive plastic body filler to cement the rip, tear, or crack. The door lock opening is then ground, using conventional techniques, or otherwise smoothed prior to being painted to give the door lock opening a "like-new" appearance.

These and other aspects and advantages of the present invention are set forth in the following detailed description and claims, particularly when considered in conjunction with the accompanying drawings in which like parts bear like reference numerals.

DETAILED DESCRIPTION OF THE EMBODIMENT SHOWN IN THE DRAWINGS

Figure 1:
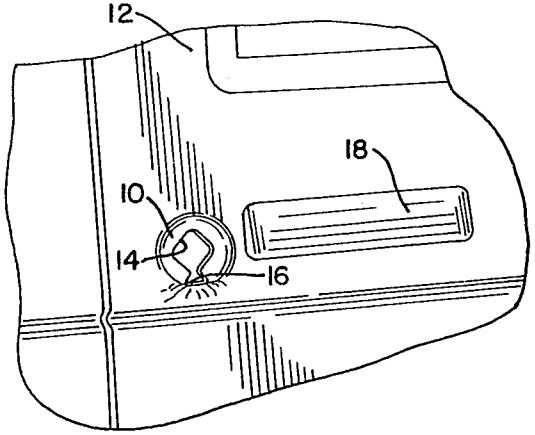
FIG. 1 is a front plan view showing a damaged automobile door lock opening.
Figure 3:
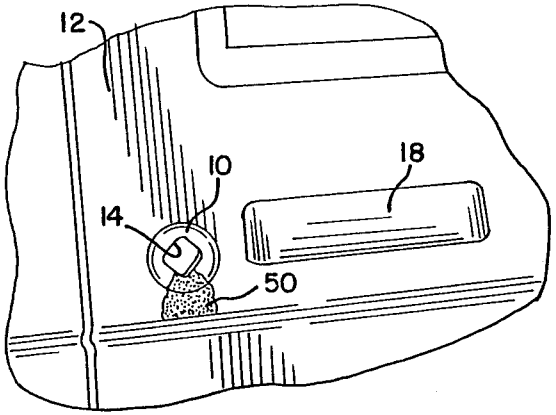
FIG. 3 is a front plan view showing a restored automobile door lock opening.

Referring now to the drawings, FIG. 1 shows a recessed door lock opening 10 located in door panel 12 of an automobile. Door lock opening 10 includes a lock passage 14 which passes through door panel 12 and into which the door lock (not shown) is normally placed. Door lock opening 10 includes a crack 16 which developed when door lock opening 10 was damaged, by a thief seeking entry into the automobile. Also shown in FIG. 1, is a handle recess 18 which is stamped in door panel 12. Normally, both door lock opening 10 and handle recess 18 are recessed relative to the exterior surface of door panel 12.

Figure 2:
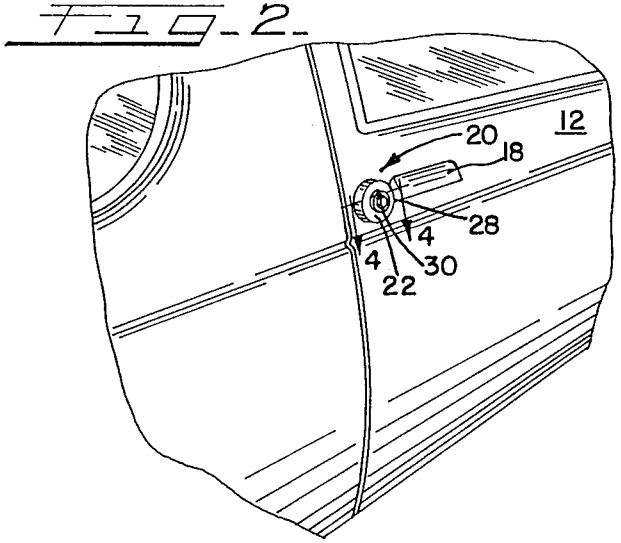
FIG. 2 is a front side view, in perspective, showing one embodiment of the present tool in place on an automobile door.
Figure 4:
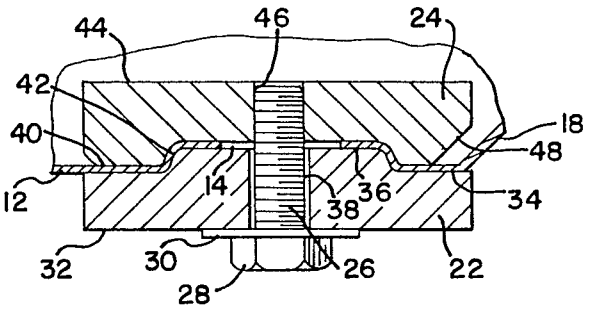
FIG. 4 is a cross-section view taken along line 4—4 of of FIG. 2.

As shown in FIG. 2, an embodiment of the present restoration tool, shown generally at 20, is illustrated attached to door panel 12 through lock passage 14. FIG. 4 provides a detailed view of tool 20, which includes first die element 22, second die element 24, threaded bolt 26 with bolt head 28, and washer 30.

First die element 22 includes a flat front surface 32, a rear surface 34, an outwardly extending projection 36 and a centrally located through hole 38. First die element 22 and projection 36 are circular in cross-section along the longitudinal axis of hole 38 which is unthreaded.

Second die element 24 includes a front surface 40, an inwardly extending indent 42, a flat rear surface 44 and a threaded, centrally located through hole 46. Indent 42 is sized and configured to receive at least a portion of projection 36. The threads in through hole 46 are structured to matingly engage the threads of bolt 26. Second die element 24 is structured so that front surface 40 forms a truncated surface 48 which extends from front surface 40 back towards rear surface 44. Truncated surface 48 allows tool 20 to be used to restore door lock opening 10 without interfering with handle recess 18, which often requires no restoration. Thus, second die element 24 is placed adjacent to the back side of door panel 12 with truncated surface 48 nearest handle recess 18. When the two die elements are brought together, as described herein, to restore door lock opening 10, handle recess 18 is unaffected since truncated surface 48 does not contact handle recess 18.

Both first die element 22 and second die element 24 are constructed of carburized steel and are harder and more durable than threaded bolt 26, which is made of carbon steel which is not heat treated. Typical dimensions for tool 20 provide, for example, that first and second die elements 22 and 24 are each one-half inch thick (at maximum thickness) and 2 7/16 inch in diameter. In this embodiment, projection 36 is 0.133 inch thick (at maximum thickness) and 1.390 inch in diameter while indent 42 is 0.141 inch in depth (at maximum depth) and 1.469 inch in diameter. Truncated surface 48 is formed at an angle at 45 degrees from front surface 40 and intersects the periphery of second die element 24 one-half inch from rear surface 44.

Tool 20 functions as follows. A damaged door lock opening 10, as shown in FIG. 1, is in need of restoration. Second die element 24 is held adjacent to the back side of door lock opening 10 while first die element 22 is held adjacent to the front side of door lock opening 10. Washer 30 is placed on threaded bolt 38 which, in turn, is placed through hole 38 and engaged with the threads in threaded hole 46. Second die element 44 is held stationary while threaded bolt 38 is threaded further into hole 46. This further threading causes first die element 22 and second die element 24 to move closer together until these two elements are as shown in FIG. 4. This further threading acts to press damaged door lock opening 10 into something resembling its original recessed shape. Washer 30 acts to more effectively distribute the pressing force caused by the further threading over the entire first and second die elements 22 and 24, respectively, so that a more effective pressing action is achieved. After this is done, tool 20 is removed from restored door lock opening 10, and a conventional automotive plastic filler 50 is applied to repair crack 16, as shown in FIG. 2. After filler 50 is applied, door lock opening 10 and the surrounding portion of door panel 12 is ground, sanded, and/or otherwise smoothed prior to being painted. The final restored door lock opening 10 is in like-new condition.

If door lock opening 10 is not recessed, first and second die elements 22 and 24 can be turned around so that door lock opening 10 is pressed between front surface 32 and rear surface 44.

The present system provides a quick, easy and effective way to restore damaged door lock openings associated with transportation vehicles.

While this invention has been described with respect to various specific examples and embodiments, it is to be understood that the invention is not limited thereto and that it can be variously practiced within the scope of the following claims.

The embodiments of the present invention in which an exclusive property or privilege is claimed are as follows:

1. A tool useful for restoring a damaged door lock opening associated with a transportation vehicle which comprises:

first die means having a hole located therethrough, a front face, and a rear face including an outwardly extending projection such that said rear face extends beyond said projection;

second die means having a hole located therethrough, a front face having an inwardly extending indent sized to be capable of receiving at least a portion of said projection, and a rear face, provided that at least one of said holes is threaded and said front face of said second die means extends beyond said indent and is at least partially angularly truncated toward said rear face of said second die means to avoid interference with other components of said door of said transportation vehicle; and bolt means adapted and sized to be capable of passing into at least a portion of both of said holes simultaneously, said bolt means including threads which are engageable with the threads in said hole or holes as said bolt means passes into said holes.

2. The tool of claim 1 wherein said first and second die means are harder than said bolt means.

3. The tool of claim 1 wherein each of said front face of said first die means and said rear face of said second die means is substantially flat.

4. The tool of claim 1 which further comprises washer means adapted and sized to be placed on said bolt means and acting to aid in distributing the force involved in passing said bolt means into said holes.

5. The tool of claim 1 wherein each of said first and second die means is generally circular in cross-section along the longitudinal axis of said hole therethrough, and said holes are centrally located through said first and second die means, respectively.

6. The tool of claim 1 wherein said front face of said second die means is partially truncated at an angle of about 45° toward said rear face of said second die means.

7. The tool of claim 1 wherein only the hole through said second die means is threaded.

8. The tool of claim 1 wherein each of said projection and said indent is generally circular in cross-section along the longitudinal axis of said hole through said first die means and said second die means, respectively, and each of said holes in said first die means and said second die means is substantially centrally located relative to said projection and said indent, respectively.

9. A method for restoring a damaged door lock opening associated with a transportation vehicle comprising:

placing a first die means having a hole located therethrough, a front face, and a rear face including an outwardly extending projection such that said rear face extends beyond said projection adjacent to one side of said damaged opening so that said projection contacts at least a portion of said damaged opening;

placing a second die means having a threaded hole located therethrough, a front face having an inwardly extending indent sized to be capable of receiving at least a portion of said projection, and a rear face adjacent to the other side of said damaged opening so that said indent faces said projection, provided that said front face of said second die means extends beyond said indent and is at least partially angularly truncated toward said rear face of said second die means to avoid interfering with other components of said door; and passing a threaded bolt means in said hole in said first die means and in said threaded hole in said second die means so that the space between said first and second die means is reduced, said threaded bolt including threads which are engagable with the threads included in said threaded hole.

10. The method of claim 9 wherein said reducing the space between said first and second die means results in restoring said damaged door lock opening.

11. The method of claim 9 wherein said first and second die means are harder than said bolt means.

12. The method of claim 9 which further comprises placing a washer means on said bolt means, said washer means acting to aid in distributing the force involved in said passing step.

13. The method of claim 9 wherein said front face of said second die means is partially truncated at an angle of about 45° toward said rear face of said second die means.

14. The method of claim 9 wherein said passing is continued until said door lock opening is restored to substantially its original shape.

15. The method of claim 9 wherein said hole through said first die is unthreaded.

16. A tool useful for restoring a damaged door lock opening associated with a transportation vehicle which comprises:

first die means having a hole located therethrough, and an outwardly extending projection;

second die means having a hole located therethrough, and an inwardly extending indent sized to be capable of receiving at least a portion of said projection, at least one of said holes being threaded; and bolt means adapted and sized to be capable of passing into at least a portion of both of said holes simultaneously, said bolt means including threads which are engagable with the threads in said hole or holes as said bolt means passes into said holes, provided that said first and second die means are harder than said bolt means.

* * * * *